US006802751B1

(12) United States Patent
Tichenor

(10) Patent No.: US 6,802,751 B1
(45) Date of Patent: Oct. 12, 2004

(54) EMERGENCY FLOATATION JACKET

(76) Inventor: Clyde L. Tichenor, 6470 LaCumbre Rd., Somis, CA (US) 93066

( * ) Notice: Subject to any disclaimer, the term of this patent is extended or adjusted under 35 U.S.C. 154(b) by 0 days.

(21) Appl. No.: 10/693,451

(22) Filed: Oct. 27, 2003

Related U.S. Application Data

(60) Provisional application No. 60/423,442, filed on Nov. 4, 2002.

(51) Int. Cl.[7] ..... B63C 9/08
(52) U.S. Cl. ..... 441/111
(58) Field of Search ..... 441/106, 108, 441/111–119

(56) References Cited

U.S. PATENT DOCUMENTS 3,266,070 A * 8/1966 O'Link ..... 441/112
3,883,914 A * 5/1975 Blair ..... 441/112
5,030,153 A * 7/1991 Bailey ..... 441/115
5,494,469 A * 2/1996 Heath et al. ..... 441/118

* cited by examiner

*Primary Examiner*—Jesus D. Sotelo

(57) ABSTRACT

An emergency floatation jacket providing emergency floatation capability in accidental deep-water immersion to keep the wearer's face above the water surface having front and back collar air reservoirs located adjacent to the upper edge of a backing support structure and front and back air reservoirs located at the lower edge of the backing support structure where reservoirs form air-pockets with the airtight front covering material when they are inflated with air. Total air volume of the upper floats equals the total capacity of the lower reservoirs and the air may be distributed by connecting air tubes to all floats and reservoirs when out of water thus providing minimum volume to any reservoir or float. In water, when worn by a heads-up person, all air is hydraulically forced into the three upper floats where sufficient upper floatation exists to keep their head above the water level.

15 Claims, 3 Drawing Sheets

EMERGENCY FLOATATION JACKET

This application claims priority of Provisional Application No. 60/423,442, filed Nov. 04, 2002

TECHNICAL FIELD

This invention provides a comfortable jacket that incorporates an emergency floatation means.

BACKGROUND ART

Newspapers and television often tell us of boating accidents and very small children who drown in a backyard swimming pool. Some pools have expensive alarm devices that sound when their pool surface is disturbed in hopes of preventing such tragedies. This invention provides a low cost practical emergency floatation system for children and adults in emergency deep-water emersion situations.

There are many forms of swimming pool toys and life jackets that provide floatation means in swimming pools, ponds, lakes, and other water bodies; some of them are made as attachable life jackets or arm floats and others are simply rings or floats in many forms. Various pool alarms also exist.

While they may provide emergency floatation for an adult or child, the means must be within their gasp when the person enters or falls into the potentially dangerous body of water. There is no assurance that this can or will be the possible at such a hazardous time, either in pools or in open bodies of water. The constant need for a safe alternative presents a difficulty because of the variety of children's play and adult activities, and the unexpected times an emergency may occur. What can they, or will they, wear in both situations. Something is needed that can be worn in water recreation activity, and in common activities such as playing and napping or sleeping, and will provide standby floatation means. Such a device is not presently available.

The aforementioned alarms provided for swimming pools and life belts that have been available for many wearers are all expensive and do not satisfy the constant needs fitting small children's needs or many adult activities requiring water safety.

The following invention provides all of these needs.

DISCLOSURE OF THE INVENTION

This invention is not a toy but a device designed to meet the needs of such an emergency and prevent the drowning of a child or adult. It allows the wearer to play, nap or sleep while maintaining a minimum floatation capability. It requires no mechanism other than its inherent hydraulically activated pneumatic float response.

A lightweight ventilated plastic jacket having in its design upper reservoirs of air suitable for head floatation that are positioned along its upper edge and are connected by air transfer tubes to similar reservoirs of air located at its lower edge. Its contained volume of air is only enough to fill the upper float-reservoirs. Contained air is free to transfer among the reservoirs. This device has the property that when immersed upright in a volume of water, the unequal water pressure will force the air in the lower reservoirs up into the upper reservoirs. The upper reservoirs are positioned to act as potential floats for the wearer's head and face.

If the total volume of air within the device is equal only to the volume of the upper float reservoir, the water immersion in upright orientation will force all contained air from the lower reservoirs to the upper ones. A jacket having only the total volume of air required to fill the upper float reservoir (say, one half its total capacity), when not immersed in water, will also freely allow the air to migrate to other reservoirs when any one reservoir is pressed flat. Under these conditions, the jacket will have little weight, no resistance to parts of it being locally pressed flat, and in general not interfere with the actions of the child or adult wearing it, or even sleeping in it In an emergency, when a person wearing it falls into a body of water, their initial position is upside-down but their natural distribution of body weight will lower their legs and elevate their head. At this time, the air in the lower reservoirs is hydraulically squeezed up into the upper float reservoirs. This provides floatation for the head and face. In such floatation, a rule of thumb is that ¼ body weight for the water weight displacement will support a person's head even when their body weight is 4 times that weight. Therefore, a volume of air displacing 8 pounds of water can float a 32-pound person's head in a breathable elevation above the water's surface.

The aforesaid jacket is designed to minimize body covering to provide cool wearing during hot weather. It also can have a back fastening means, and a bottom between-the-legs strap that also fastens at the jacket back, and can be used to maximize its secure attachment for children. Adults simply need a front fastening jacket.

A BRIEF DESCRIPTION OF THE DRAWINGS

FIG. 1 diagrams the hydraulic and pneumatic principals that the invention utilizes.

BEST MODE FOR CARRYING OUT THE INVENTION

Figure 1:
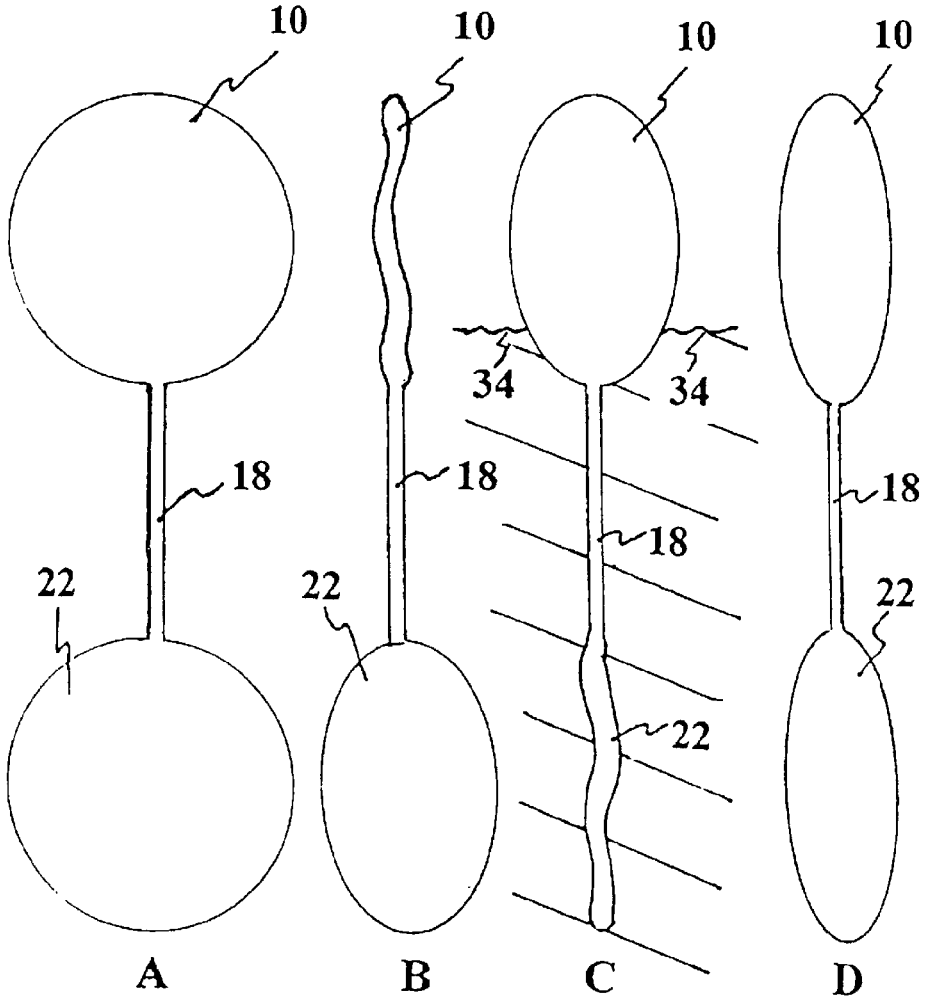

FIG. 1 has four diagrams marked A through D. View A represents a face on view of a pair of reservoirs where the upper one is termed a float 10 and the lower one is termed a reservoir 22. Views B through D represent the same pairs but from a sideward aspect. Pair B depicts them in an air environment and the upper float 10 as pressed flat so that its volume is transferred via the air transfer tube to the lower reservoir 22, Pair C represents the condition of B after immersion in water to the water lever 34 as shown. It may be seen that the hydraulic pressure of the water has forced the lower reservoir 22 air through the air transfer tube 18 into the now upper float 10. View D again is an air environment where the pair 10 and 22 has equal volume. These A through D diagrams illustrate the arbitrary interchangeability of the internal air volume except when the pair is in a water immersion (C) where one reservoir 22 is elevated with relation to the other.

Figure 2:
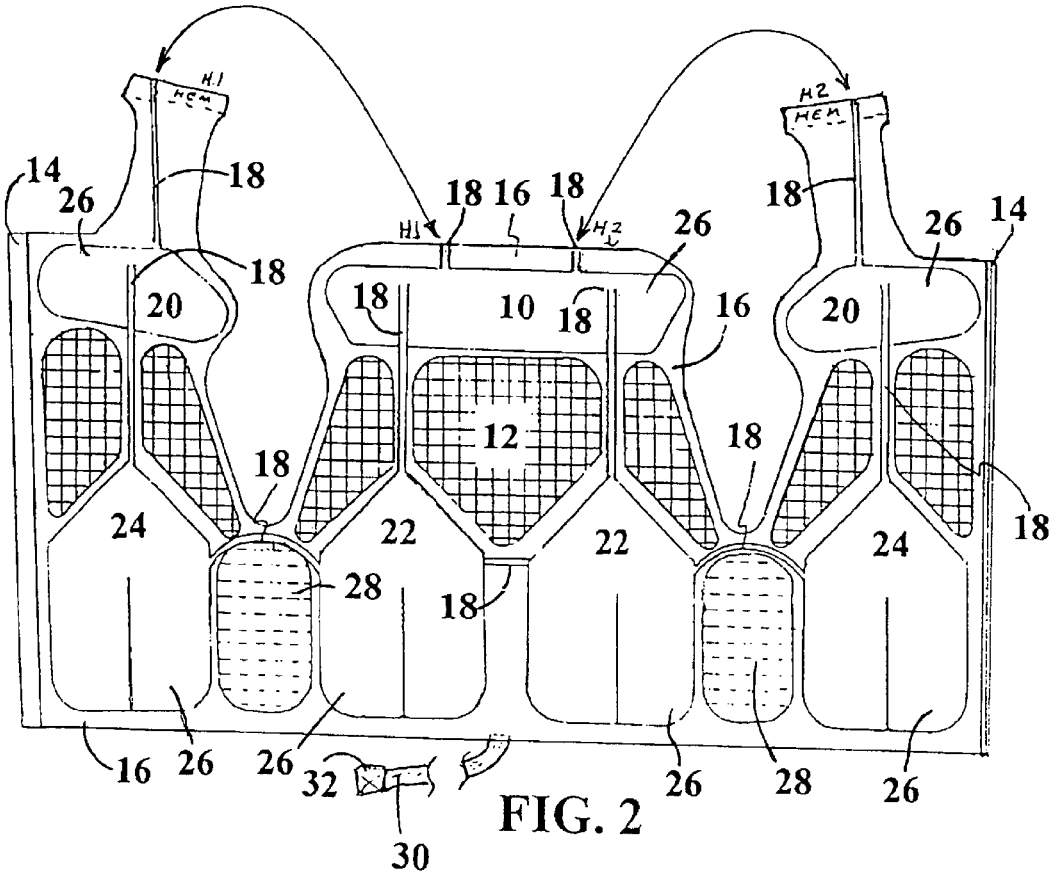
FIG. 2 is a two-dimensional representation (opened and flattened) of a typical configuration of the invention.
Figure 3:
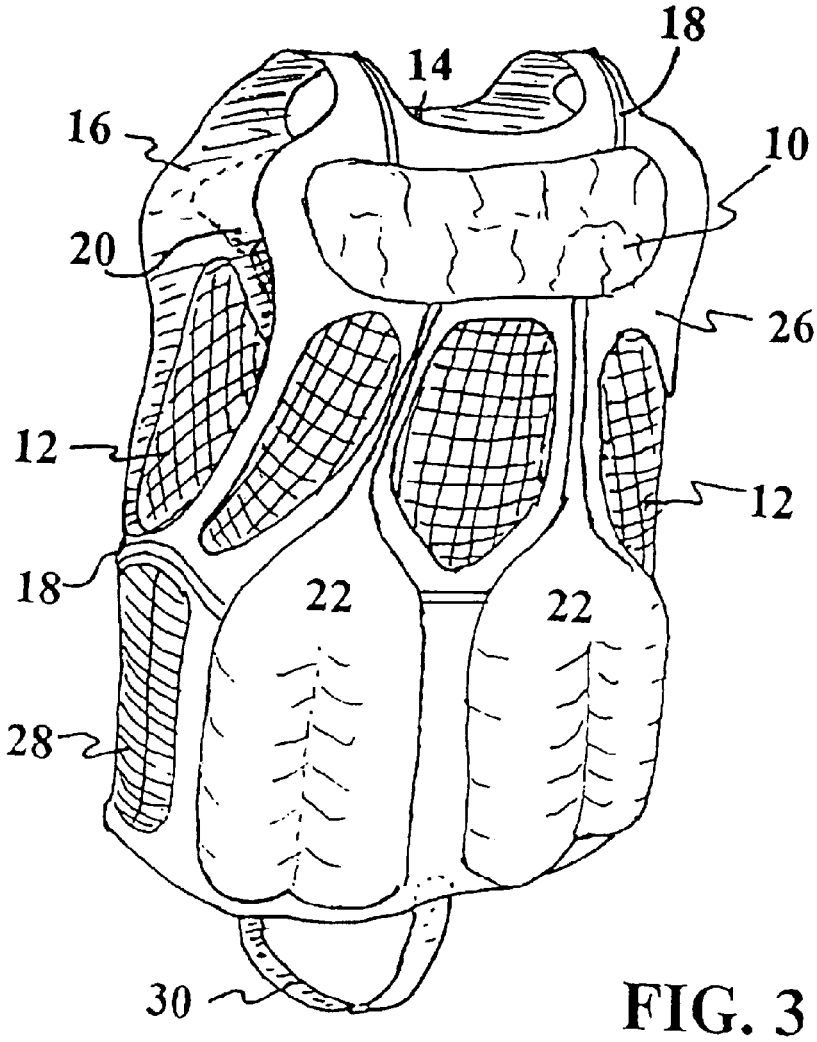
FIG. 3 is a perspective drawing of the Playable Emergency Floatation Jacket.

FIG. 2 is a two-dimensional representation of a jacket (opened and flattened) showing a typical configuration of the invention to simplify understanding. Basically the construction (as seen in FIG. 3 also) consists of two primary parts that are the airtight backing support material 16 bonded to the airtight covering material 26 in which there are ventilation scrim 12 areas and float/reservoirs 10, 20, 22, 24 contain captured air volumes and have air tube interconnecting means 18. Designed to consider the upper and lower relations of the human body the jacket has an upper front collar float 10 and two additional collar floats 20 located adjacent the upper side fastening edges. Two front reservoirs 22 and two back reservoirs 24 are located at its lower edge. These reservoirs are the upper floats 10, 20 and are connected to the lower reservoirs 22, 24 by various air transfer tubes 18 that also interconnect the lower reservoirs 22, 24. Reservoirs 22, 24 have partial center seams to minimize bellowing when inflated. The upper floats 10, 20 are designed so the entering air transfer tubes 18, connecting the lower reservoirs 22, 24, are carried to the upper area of the floats 10, 20. This is to minimize exiting air transfer incase of wearer inversion in water. Two above-the-arm straps 36 are shown wherein one end is integral and the other end fastened during manufacture thus forming a jacket when the two hems, H1 and H2 are joined to the top front of the jacket at H1 and H2 respectively.

In addition, FIG. 2, has crosshatched areas that indicate ventilating scrim 12. In the lower part of the jacket, two elastic vent scrims 28 help to adjust the jacket fit to the person's body. The jacket is designed to provide a front or back fastener means 14 for closure. This later provides an inaccessible fastener so the children cannot remove it themselves. Where deemed necessary for very small children, a between-the-legs strap 30 and fastener 32 may also be utilized.

FIG. 3 is a clarifying perspective drawing of the assembled Emergency Floatation Jacket shown without an occupant. All numbers are the same references as FIG. 2. The front reservoirs 22 are shown fully inflated to aid understanding of their construction. Normally they might be partially or completely flat. The front collar 10 is shown as essentially flat with little air.

It is contemplated, but not shown, that one or more matching external items of clothing may be desirable for use with the playable jacket. This would allow extra abrasion and wear protection, choice of colors and a second washable item while one item is being worn.

While the invention has been described in complete detail and pictorially shown in the accompanying drawings, it is not to be limited to such detail, since many changes and modifications may be made in the invention without departing from the spirit and scope thereof.

What is claimed is:

1. An emergency floatation jacket suitable for wear during recreation, play and sleeping that provides emergency floatation capability in accidental deep water immersion to keep the wearer's face above the water surface, said jacket comprising:

a) an airtight backing support material having an upper edge, a lower edge and vertical edges, b) a front airtight covering material bonded to said airtight backing support structure, c) front and back collar air reservoirs located adjacent to the upper edge of said airtight backing support material by forming and bonding the front airtight covering material, wherein said reservoirs act as floats for the wearer's head, d) front and back air reservoirs located adjacent the lower edge of the airtight backing support material by forming air-pockets with the front airtight covering material, e) a plurality of air transport tubes interconnecting said collar air reservoir floats and said air reservoirs, and f) means for fastening the vertical edges of the airtight backing support material.

2. The emergency floatation jacket according to claim 1 wherein at least one collar air reservoir float is positioned on said airtight backing support material adjacent the wearer's neck and head so as to maintain their face above the water surface during floatation.

3. The emergency floatation jacket according to claim 2 wherein there is at least two of said interconnected collar air reservoir floats are positioned adjacent the neck and head so as to keep the wearer's face above the water surface during deep immersion.

4. The emergency floatation jacket suitable according to claim 3 that has at least one front and one back air reservoir interconnected by air transfer tubes positioned at the lower edge and that have a combined volume equal or greater than the total of said collar air reservoir float volume.

5. The emergency floatation jacket according to claim 4 that has at least one interconnected air transfer tubes wherein said air reservoir is positioned at the jacket's lower edge has a tapered upper configuration funneling its air to an upper air transfer tube.

6. The emergency floatation jacket according to claim 5 wherein said upper air transfer tubes connecting the lower reservoirs extend to the upper locations within said collar floats.

7. The emergency floatation jacket according to claim 1 wherein the volume of air in said collar floats and said air reservoirs can readily move from one to the other during recreational use or reclined sleep allowing them to flatten and minimize body interference.

8. An emergency floatation jacket suitable for wear during recreation play and sleeping that provides emergency floatation capability in accidental deep water immersion to keep the wearer's face above the water surface, said jacket comprising:

a) an airtight backing support structure having an upper edge and a lower edge, b) an airtight front covering material with selected airtight bonding to said backing support structure, c) front and back collar air reservoirs located adjacent to the upper edge of said backing support structure by forming and bonding the front covering material and wherein said reservoirs act as floats for the wearer's head, d) front and back air reservoirs located at the lower edge of the backing support structure by forming air-pockets with the airtight front covering material, e) a plurality of air transport tubes interconnecting said collar air reservoir floats and said air reservoirs; and f) a fastening means for the vertical edges of the airtight backing support material wherein the combination acts to transfer air in the air transfer tubes to upper collar floatation means because of the difference in water pressure when the person wearing the jacket assumes a normal heads-up orientation in the water.

9. The emergency floatation jacket according to claim 8 having a combined total contained air that provide the required volume to the collar floats and having the air reservoirs with interconnecting air transfer tubes that readily transfer said air from one location to another and to minimize body interference during the recreation and sleep times of the wearer by allowing such air volume transfer.

10. The emergency floatation jacket according to claim 9 wherein said air reservoirs are divided in two parts by a bonded seam that starts at the lowest reservoir extremity and terminates between 50 and 75 percent of the reservoir's upper length to provide greater lower puncture air loss isolation and minimize billowing when inflated.

11. The emergency floatation jacket according to claim 10 wherein a jacket fastener means is provided in a wearer-inaccessible location such as the back center.

12. The emergency floatation jacket according to claim 10 wherein a jacket fastener means such as a zipper is provided.

13. The emergency floatation according to claim 10 wherein a jacket fastener means is provided.

14. The emergency floatation jacket according to claim 8 wherein said lower backing structure has at least one elastic scrim section to provide adjustable fit.

15. The emergency floatation jacket according to claim 8 wherein a between-the-legs strap is provided with fastening means.

* * * * *